United States Patent [19]

Link

[11] 4,196,408

[45] Apr. 1, 1980

[54] HIGH TEMPERATURE TRANSFORMER ASSEMBLY

[75] Inventor: Edwin A. Link, Waukesha, Wis.

[73] Assignee: RTE Corporation, Waukesha, Wis.

[21] Appl. No.: 599,372

[22] Filed: Jul. 28, 1975

Related U.S. Application Data

[63] Continuation of Ser. No. 433,053, Jan. 14, 1974, abandoned, which is a continuation-in-part of Ser. No. 292,670, Sep. 27, 1972, abandoned.

[51] Int. Cl.[2] ..... H01F 27/02

[52] U.S. Cl. ..... 336/94; 174/17 LF; 208/14; 252/63; 336/206

[58] Field of Search ..... 336/92, 94, 58, 206; 174/15 R, 17 R, 17 LF, 17 SF; 208/14, 38, 264, 89, 58; 252/63

[56] References Cited

U.S. PATENT DOCUMENTS

| | | | |
|---|---|---|---|
| 854,277 | 5/1907 | Darlington | 174/15 R |
| 1,891,959 | 12/1932 | Sprong | 336/94 X |
| 2,036,068 | 3/1936 | Montsinger | 336/94 |
| 3,011,972 | 12/1961 | Watson et al. | 208/38 |
| 3,212,563 | 10/1965 | Schrader | 336/58 |
| 3,234,493 | 2/1966 | Zwelling et al. | 336/94 |
| 3,318,799 | 5/1967 | Acker et al. | 208/14 |
| 3,431,198 | 3/1969 | Rausch | 208/264 |
| 3,494,854 | 2/1970 | Gallagher | 208/89 |
| 3,544,938 | 12/1970 | Bengmann et al. | 336/92 |
| 3,551,324 | 12/1970 | Lillard | 208/14 |
| 3,587,168 | 6/1971 | Kolator | 336/94 X |
| 3,642,610 | 2/1972 | Dirijak | 208/58 |
| 3,670,276 | 6/1972 | Theodore | 336/94 |
| 3,732,154 | 5/1973 | Mills et al. | 208/14 X |
| 3,759,817 | 9/1973 | Mills et al. | 208/14 |
| 3,839,188 | 10/1974 | Mills et al. | 208/14 |
| 3,849,288 | 11/1974 | Milstein et al. | 208/14 |

FOREIGN PATENT DOCUMENTS

| | | | |
|---|---|---|---|
| 38-16965 | 9/1963 | Japan | 174/17 SF |
| 578869 | 7/1946 | United Kingdom | 174/17 SF |

OTHER PUBLICATIONS

Lipshtein et al., "Transformer Oil", 1970, pp. 1 and 2.

"High Power High Voltage Audio Frequency Transformer Design Manual", Howe et al.; Jul. 1, 1962–Aug. 31, 1964; pp. 159, 161, 184, 185, 188, 189, 192, 195, 200, 201, 207, 210, 244.

*Primary Examiner*—Thomas J. Kozma

*Attorney, Agent, or Firm*—Ronald E. Barry

[57] ABSTRACT

A power transformer having an operating temperature in excess of 200° C. and including a casing or tank, an electrical core and coil assembly having an asbestos based barrier material and being supported in said casing, and a low cost saturated hydrocarbon insulating fluid substantially filling the casing and having a vapor pressure at 200° C. less than 10 millimeters of mercury and a flash point in excess of 230° C.

7 Claims, 2 Drawing Figures

HIGH TEMPERATURE TRANSFORMER ASSEMBLY

CROSS REFERENCE TO RELATED APPLICATION

Figure 1:
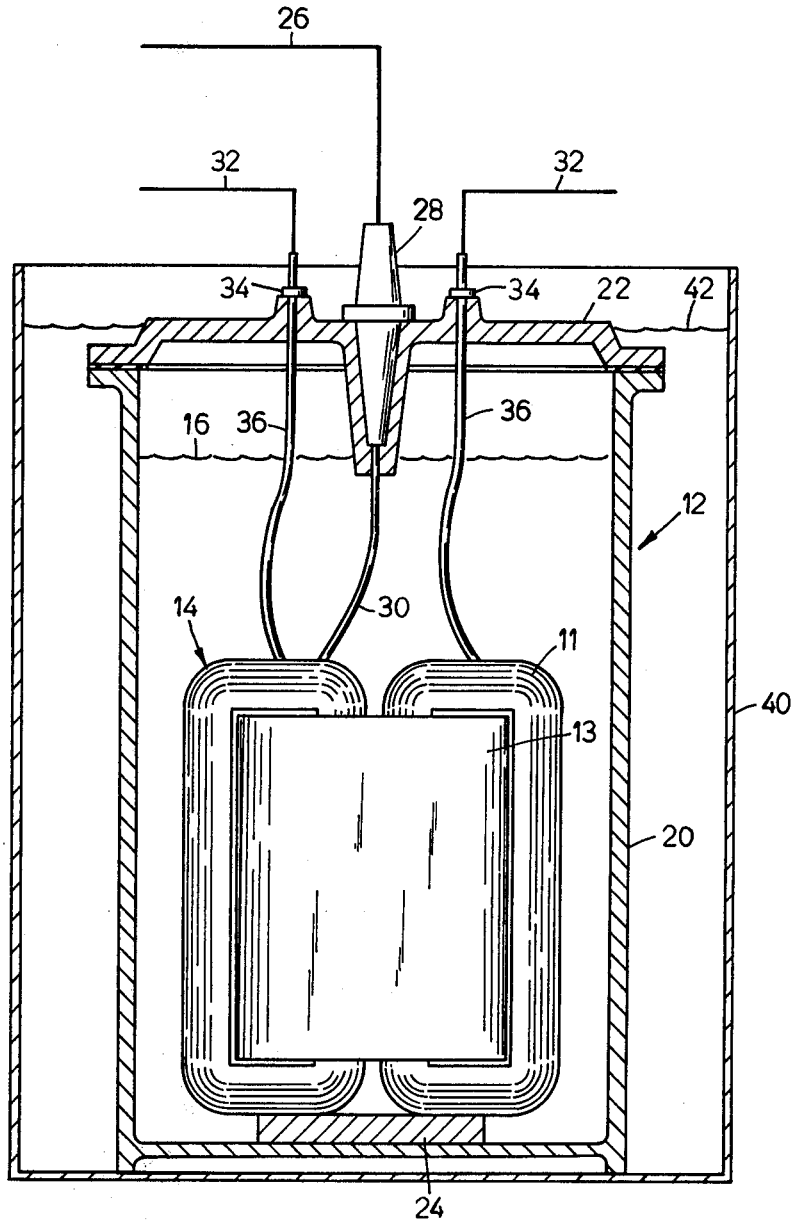

This application is a continuation of my copending application Ser. No. 433,053, now abandoned filed on Jan. 14, 1974, which is a continuation-in-part of my application Ser. No. 292,670, filed on Sept. 27, 1972 and entitled "High Temperature Transformer Assembly" (now abandoned).

BACKGROUND OF THE INVENTION

The thermal capabilities of liquid insulating transformer systems is limited by the breakdown temperatures of the various components used in the manufacture of the transformer. These systems have been operated at temperatures or approximately 55° C. above ambient temperature. Recently, the operating temperature has been raised to 65° C. above ambient by the thermal upgrading of the kraft insulating barrier material.

Since the operating characteristic of transformers is, therefore, limited to the operating temperature of the insulating material used in the manufacture of the transformer, efforts have been made to determine the lowest breakdown of the various insulating materials and to upgrade these materials while maintaining compatibility with the insulating fluid. Attempts to raise the operating temperature in order to increase the operating characteristics of the transformer have not been successful due primarily to the inability to achieve compatibility between the various insulating materials used in the transformer and the insulating fluid. The only high temperature insulating fluids that are presently known to be capable of use in a high temperature transformer are too expensive to be of any practical value.

Class H insulating systems operate at temperatures above 200° C. and allow hot-spot temperatures of 220° C., are dry insulation systems without a liquid coolant. These transformers, because of solidness and their combining of metal conductors and barrier materials at different coefficients of expansion, have a tendency to crack and craze due to thermal cycling under normal operating conditions. These transformers have been limited to a high voltage of 15 kv. Because of the trend to higher and higher primary voltages, it has become imperative to develop a Class H transformer system which can be practically applied economically. Fluid filled systems are the only successful systems which allow designs at these higher voltages.

Askerols have been considered for use as a high temperature insulating fluid for power transformers. However, the askerols have been found to be toxic and have been objected to by environmentalists because the askerols are not biodegradeable. Because of this objection to the use of the askerols, industry has been looking for a more thermally stable insulating fluid having a flash point sufficiently high to reduce the potential fire hazard.

The conventional transformer oils, i.e. Transil Oil, petroleum oil and parafins all have operating temperature limits and particularly flash points below those required for the present application. Saturated hydrocarbons which are biodegradeable having operating temperatures of 200° C. have not been used commercially as a transformer oil until the present.

SUMMARY OF THE INVENTION

The power transformer of the present invention is capable of operating at a higher kv rating at substantially the same efficiency with no physical change in the size of the transformer. Alternatively, cash savings can result in making a transformer of a given kv rating by employing the insulating system as outlined hereinafter. This has been achieved by operating the transformer assembly of the present invention at temperatures approximately 100° C. higher than operating temperatures of a standard liquid insulating transformer.

In order to achieve the above, a liquid Class H power transformer was developed which can operate at higher voltage and can withstand high temperature thermal cycling. The core and coil assembly is assembled in a tank and immersed in a high temperature insulating liquid. Insulating liquids, with the exception of silicones and halogenated hydrocarbon, have not been previously available for high temperature operation. In order to use these high temperature liquids, the core and coil assembly has been constructed using barrier and conductor insulating materials which are compatible with the insulating liquid. These materials can survive high temperature and the rigorous mechanical stresses resulting from thermal cycling. In this regard it has been found that high temperature insulating liquids such as saturated hydrocarbons are compatible with high temperature asbestos material and polyamide barrier materials as well as polybutidiene and polyimide insulation materials for the conductors.

The transformer casing can be cooled by submerging the casing in water so that the heat of vaporization of the water will provide a medium for dissipating heat from the transformer.

Figure 2:
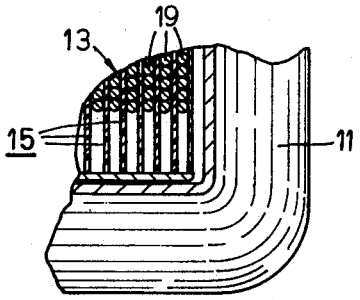

Other objects and advantages of the invention will become apparent from the following detailed description when read in connection with the accompanying drawings in which:

FIG. 1 is a cross sectional view of a power transformer according to the present invention; and FIG. 2 is an enlarged view of a section of the coil assembly showing the barrier material.

DESCRIPTION OF THE INVENTION

The power transformer 10 of the present invention generally includes a tank or a casing 12, an electric core and coil assembly 14 and an insulating fluid 16 substantially filling the inside of said tank. The core and coil assembly 14 includes primary and secondary leads 30 and 36, respectively, which are connected to high voltage cables 26 and secondary cables 32. Termination of the primary and secondary leads 30 and 36 is accomplished by means of bushings 28 and 34 sealed in the walls of the tank. In accordance with the invention, the materials which have been used to form the tank or casing 12 and the core and coil assembly 14 have been selected to be compatible with the insulating fluid at transformer operating temperatures in excess of 200° C. making it possible to increase the operating characteristics of the power transformer.

In this regard, it has been found that in order to make an economical Class H transformer which will operate at higher rated voltages and can stand up under thermal cycling, an insulating system of a liquid type is the most desirable. Many high temperature stable liquids have been evaluated for compatibility with the various solid components of the insulation system. These combinations were subjected to rigorous heat stability tests in glass ampules which were hermetically sealed by fusion of the glass. It was found that products of decomposition or chemical reaction form gasses which cause pressure build up and eventual ampule breakage when subjected to long time aging at 255° C. Sludge formation could be studied visually as the tests proceeded. Processing techniques in preparing the ampule were evaluated. From these tests it was determined that a saturated hydrocarbon could be used as the insulating fluid and was compatible with the insulating barrier material used in the core and coil assembly.

THE CORE AND COIL ASSEMBLY

The core and coil assembly 14 is shown in the form of a transformer. In the present invention, the core and coil assembly includes a core 11 and a coil 13. The coil 13 includes barrier materials 15 which have high dielectric strength and are compatible with the insulating fluid. One material found satisfactory for this purpose is a material described as "Quintex" made by Johns Manville. This material is composed of over 89% asbestos fibre, with small amounts of high temperature synthetic textile fibre, and an elastomeric binder and has a dielectric strength greater than 200 volts per mil. The barrier material is secured to the coil assembly by means of a varnish adhesive such as the Dow Corning 997 varnish which is painted on the barrier materials on assembly.

The conductors 19 of the core and coil assembly are insulated by a high temperature film which is also compatible with the insulating fluid. Polybutidiene and polyimide films have been used successfully in this assembly.

It is important in the production of the core and coil assembly that it be subjected to a thermal condition bake in order to drive off all unsaturated and unstable low molecular weight groups which have been used for constructing the core and coil assembly. Elevating the temperature of the core and coil assembly to 250° C. for a period of two to four hours prior to impregnation with the dielectric fluid has been satisfactory for this purpose.

THE INSULATING FLUID

The insulating fluid 16 must be compatible with the materials of the core and coil assembly at the operating temperature of the assembly. Fluid such as a saturated hydrocarbon has been found to be compatible with the barrier insulation of the core and coil assembly. The low vapor pressure requirement minimizes the possibility of evaporating the oil.

A fluid which has been found satisfactory for the invention is a Sinclair Oil Company oil designated by the Formula No. L-1811. This fluid is commonly referred to as a dual treat base oil which is a solvent treated, deeply hydrogenated bright stock and is an almost entirely paraffinic oil with a molecular weight in excess of 600. It has a distillation range by ASTM test -- D1160 as follows. The initial boiling point at atmospheric pressure is 760° F.; the 5% point is 891° F.; the 10% point is 920° F.; the 50% point is 1,050° F. Above 50% it is 1,051° F. to 1,250° F. It has an annolin point of 256° F. (a higher degree of paraffinic structure). This oil has characteristics as follows:

| | Formula A |
|---|---|
| Gravity, °API | 28.8 |
| Flash Point °C. | 296 |
| Fire Point, °C. | 321 |
| K Vis. at 100° F., cs | 414.1 |
| K Vis. at 210° F., cs | 27.33 |
| Vis. at 100° F., SSU | 1919 |
| Vis. at 210° F., SSU | 130.5 |
| Extrapolated Vis. at 0° F., SSU | 450,000 |
| Pour Point °C. | −5 |
| Color | 30 |
| Sulfur, % | Less than 0.001 |
| Corrosive Sulfur (D-1275) | Pass |
| Vapor Pressure at 200° C., mm Mercury | 0.01 |

THE CASING

The casing 12 shown in the drawing is only one of a number of types of casings that can be used for this type of installation. The casing 12 includes a container 20 and a cover 22 sealed to the top of the container 20. The core and coil assembly 14 is supported on pedestal 24.

Electrical termination is made to the high voltage distribution line 26 by means of a bushing 28 connected to the primary lead 30. Electrical termination is made to the service lines 32 by means of bushings 34 connected to the secondary leads 36.

The casing 12 is filled with the insulating fluid 16 to a level sufficient to completely cover the core and coil assembly 14. An air space is provided at the top of the container to allow for expansion and contraction of the fluid during cycling.

THE COOLING SYSTEM

The power transformer 10 as seen in FIG. 1, can be cooled by using the heat of vaporization of a medium such as water to dissipate heat from the casing 12. In this regard a shell or vault 40 is provided around the transformer casing in a spaced relation thereto. The shell or vault 40 is filled with water sufficiently to completely immerse the power transformer. Any heat build up on the walls of the casing 12 will be carried away from the walls by the heat of vaporization of the water.

The embodiments of the invention in which an exclusive property or privilege is claimed are defined as follows:

1. A liquid, Class H, power transformer comprising:
a casing,
a core and coil assembly having an operating temperature in excess of 200° C. supported within said casing,
said assembly including an insulating barrier material,
means in said casing for terminating said core and coil assembly externally of said casing,
a saturated hydrocarbon insulating liquid in said casing completely covering said core and coil assembly,
said liquid being compatible with the barrier material for said core and coil assembly and having a vapor pressure at 200° C. less than 10 millimeters of mercury and a flash point in excess of 230° C.

2. The transformer according to claim 1 wherein all unsaturated and unstable low molecular weight groups have been removed from said core and coil assembly prior to impregnation with said fluid.

3. The transformer according to claim 1 wherein said insulating barrier material includes a major proportion of asbestos fiber.

4. A power transformer comprising:

a casing, a core and coil assembly having an operating temperature in excess of 200° C. supported within said casing, means in said casing for terminating said core and coil assembly externally of said casing, a saturated hydrocarbon, dielectric liquid in said casing completely covering said core and coil assembly, said liquid being compatible with said core and coil assembly and having a vapor pressure at 200° C. less than 10 millimeters of mercury and a flash point in excess of 230° C.

5. The transformer according to claim 4 wherein said core and coil assembly includes an asbestos based barrier material.

6. The transformer according to claim 4 wherein said core and coil assembly has all unsaturated and unstable, low molecular weight groups removed.

7. The transformer according to claim 4 wherein said liquid is biodegradeable.

* * * * *